US010112383B2

(12) United States Patent
Barnel et al.

(10) Patent No.: US 10,112,383 B2
(45) Date of Patent: Oct. 30, 2018

(54) COMPENSATING PLATEN DEFECTS BASED ON PRINTHEAD-TO-PLATEN SPACING

(71) Applicant: HEWLETT-PACKARD DEVELOPMENT COMPANY, L.P., Houston, TX (US)

(72) Inventors: Frederic Barnel, Sant Cugat del Valles (ES); David Toussaint, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/541,392

(22) PCT Filed: Jan. 30, 2015

(86) PCT No.: PCT/US2015/013760

§ 371 (c)(1),
(2) Date: Jul. 3, 2017

(87) PCT Pub. No.: WO2016/122592

PCT Pub. Date: Aug. 4, 2016

(65) Prior Publication Data

US 2017/0361606 A1 Dec. 21, 2017

(51) Int. Cl.

| | |
|---|---|
| ***B41J 2/045*** | (2006.01) |
| ***B41J 2/15*** | (2006.01) |
| ***B41J 2/21*** | (2006.01) |
| ***B41J 25/308*** | (2006.01) |
| *B41J 11/02* | (2006.01) |

(52) U.S. Cl.

CPC ..... *B41J 2/04506* (2013.01); *B41J 2/04586* (2013.01); *B41J 2/15* (2013.01); *B41J 2/2135* (2013.01); *B41J 25/308* (2013.01); *B41J 11/02* (2013.01)

(58) Field of Classification Search

CPC ..... B41J 29/393; B41J 25/308; B41J 29/38; B41J 2/04586; B41J 2/04505; B41J 2/04506

USPC ..... 347/8, 14, 16, 19

See application file for complete search history.

(56) References Cited

U.S. PATENT DOCUMENTS

| | | | |
|---|---|---|---|
| 6,027,264 | A | 2/2000 | Maher et al. |
| 6,290,319 | B1 | 2/2001 | Boleda et al. |
| 7,055,925 | B2 | 6/2006 | Subirada et al. |
| 7,156,482 | B2 | 1/2007 | Boleda et al. |
| 7,588,302 | B2 | 9/2009 | Bastani et al. |
| 8,282,184 | B2 | 10/2012 | Jackson et al. |
| 8,313,163 | B2 | 11/2012 | Eun et al. |
| 2004/0080553 | A1 | 4/2004 | Kim |
| 2007/0070099 | A1 | 3/2007 | Beer et al. |
| 2013/0249979 | A1 | 9/2013 | Wing et al. |
| 2013/0286103 | A1 | 10/2013 | Fricke et al. |

OTHER PUBLICATIONS

Webpage, DESIGNJET 800PS Service Manual, Jan. 13, 2014.

*Primary Examiner* — Jannelle M Lebron
(74) *Attorney, Agent, or Firm* — HP Inc. Patent Department

(57) ABSTRACT

In one example, an apparatus is described, which includes a platen locating the print medium, at least one printhead for marking on the print medium, a carriage holding the at least one printhead, a sensor at least partially mounted to the carriage to measure a printhead-to-platen spacing (PPS) along scanning axis during scanning, and an integrated circuit including a dynamic compensation module and a PPS analysis module to delay firing of printing fluid drops from the at least one printhead to compensate platen defects based on the measured PPS.

12 Claims, 6 Drawing Sheets

COMPENSATING PLATEN DEFECTS BASED ON PRINTHEAD-TO-PLATEN SPACING

BACKGROUND

The art of ink-jet technology is relatively well developed. Commercial products such as printers, graphics plotters, copiers, and facsimile machines employ ink-jet technology for producing a hard copy. In ink-jet apparatuses, the print medium on which the printing will be performed is loaded upon a flat structure (i.e., platen), the planarity of which may realize an efficient printing process.

DETAILED DESCRIPTION

Figure 1:
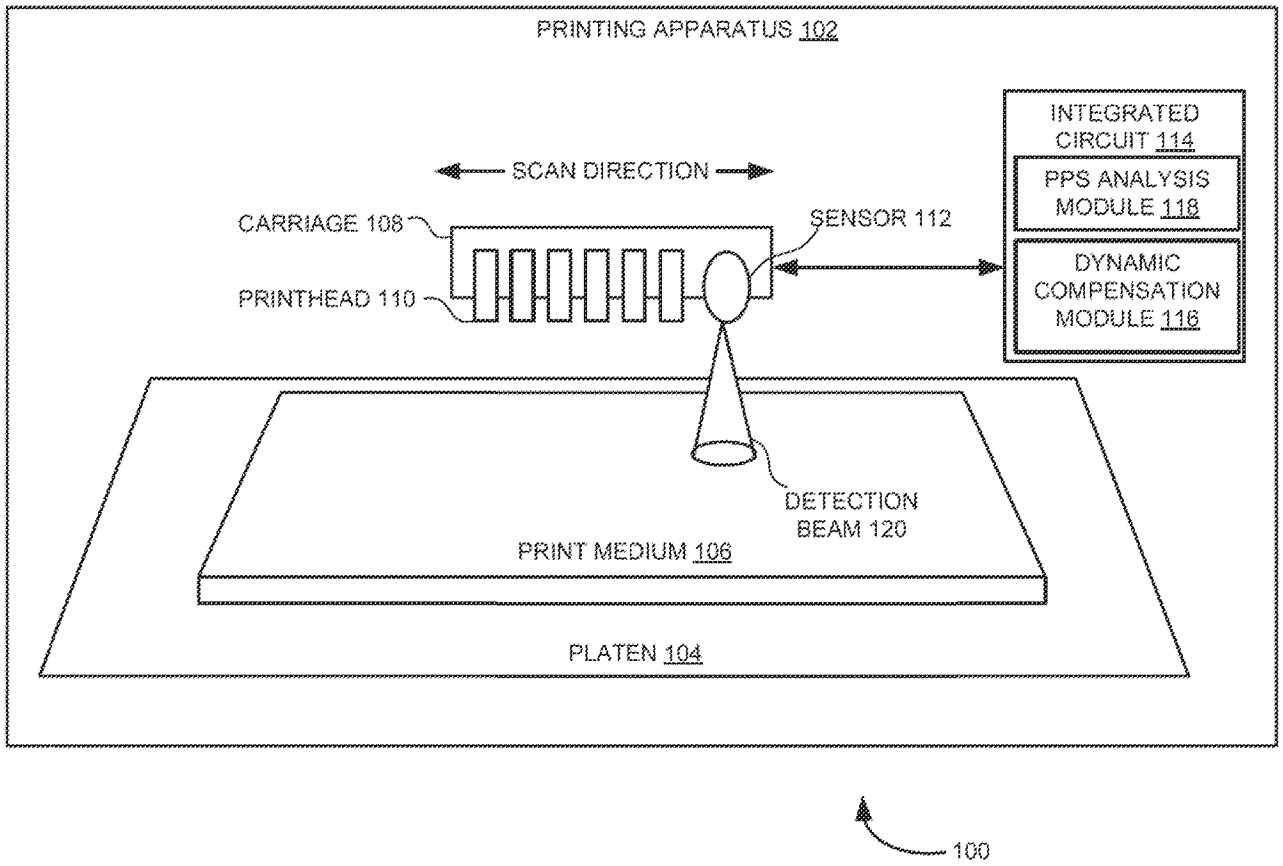
FIG. 1 is a block diagram illustrating components of an example printing apparatus with printhead-to-platen spacing (PPS) profile determination and compensation.

In the following description and figures, some example implementations of systems and/or methods for compensating platen defects based on a printhead-to-platen spacing (PPS) profile in a printing apparatus are described. The printing apparatus includes a platen locating a print medium, at, least one printhead for marking on the print medium, a carriage holding the printhead, and a rod supporting the carriage for scanning motion across the print medium.

As platen structure is not immune from defects (e.g., imperfect planarity or cylindricity of the platen), some apparatuses may include a feature that allows firing of printing fluid drops to be adjusted (e.g., delayed) to compensate these defects. This feature may be facilitated through a module of a chipset (e.g., field-programmable gate array (FPGA) or application-specific integrated circuit (ASIC)) that is in charge of transforming the input plot into firing drops for the printhead, referred to as Dynamic X compensation (DNX).

The defaults (e.g., mechanical defects) of the planarity of the platen may be detected by printing a plot, scanning the plot and comparing the scanned plot with the original plot sent to be printed. The differences between the scanned plot and the original plot (i.e., difference between expected plot and actually printed plot) may be processed in order to program the DNX module. However, this process may compromise on the final image quality of the plots or the printer integrity. For example, the print quality may also be affected due to various other factors such as printhead health, printhead position within the carriage, printhead orientation, printhead energy calibration, type of substrate, and the like. Therefore, all these factors may generate artifacts to the printed plot that may be interpreted as the platen defaults.

Further, as the platen analysis requires printing a plot, the actual process may endanger the printer integrity. If the platen has a default due to either a bad assembly or a bad shape of one of the components, it may result in a printhead collision with the platen/print medium that may damage the printhead. Furthermore, printing, scanning and analyzing the plot may be a relatively long process, which may result in consuming significant resources, such as printing fluid, substrate, operator working time, and the like.

Various examples described below relate to a sensor, at least partially mounted to the carriage, for measuring relative distances between the printhead and an upper surface of the print medium or the platen, herein referred as PPS (printhead-to-platen spacing or printhead-to-print medium spacing). In one example, the sensor may be a short range distance sensor with a precision of 0.1 mm to characterize the platen profile and apply corrections. Furthermore, various examples described below relate to a PPS analysis module for computing a PPS profile by sampling the measured PPS at multiple positions along the scanning axis and programming a dynamic compensation module to adjust/control the firing of printing fluid drops (e.g., ink drops) from the at least one printhead to compensate the platen defects based on the computed PPS profile. The dynamic compensation module is a feature of a chipset (e.g., ASIC or FPGA) in charge of transforming the input plot into firing printing fluid drops for the printhead. In one example, the dynamic compensation module can be dynamically/automatically programmed to delay the firing of printing fluid drops (e.g., to compensate the defects in planarity of the platen) from the at least one printhead based on the computed PPS profile, position and/or speed of the carriage, and velocity of propagation of the printing fluid drops from the printhead towards the print medium.

Also, various examples described below relate to loading a bare print medium (i.e., unprinted print medium) on to a platen in the printing apparatus, measuring a PPS along scanning axis by a sensor at least partially mounted to a carriage by initiating the carriage movement along the complete scanning axis, and adjust firing of printing fluid drops from the at least one printhead to compensate the platen defects based on the measured PPS. In one example, the sensor may measure the PPS substantially along the length of the complete scanning axis without actually printing on the print medium.

FIG. 1 is a block diagram 100 illustrating components of an example printing apparatus 102 with PPS profile determination and compensation, according to one example. Referring to FIG. 1, the printing apparatus 102 includes a platen 104 locating the print medium 106, at least one printhead (e.g., 110) for marking on the print medium 106, and a carriage 108 holding the at least one printhead 110. The printing apparatus 102 as illustrated in FIG. 1, describes a scan printer in which the printheads are within a carriage which moves along a scan axis. In another example, the printing apparatus can also be a page wide array printer, which includes an array of printheads for marking on the print medium 106, the array is of length at least equal to that of the width of the print medium 106. In such a page wide array system, the printheads are not within the carriage but a PPS scan of the whole platen can be performed as illustrated for a scan printer.

Further, the printing apparatus 102 includes a sensor 112 at least partially mounted to the carriage 108. Furthermore, the printing apparatus 102 includes an integrated circuit 114. For example, the integrated circuit 114 can include a chipset such as ASIC, FPGA, and the like. In one example, the integrated circuit 114 includes a dynamic compensation module 116 and a PPS analysis module 118. The dynamic compensation module 116 allows firing of printing fluid drops to be delayed to compensate the defects/imperfections of the platen 104. In the example shown in FIG. 1, the PPS analysis module 118 is shown as residing in the integrated circuit 114, however, it can reside anywhere within or outside the printing apparatus 102 and can be communicatively coupled to program the dynamic compensation module 116. The dynamic compensation module 116 and the PPS analysis module 118 represent any combination of circuitry and executable instructions to delay the firing of printing fluid drops from the printhead 110 based on the measured PPS.

The PPS sensor (i.e., included in the carriage 108 as illustrated in FIG. 1 for a scan printer) scans across a surface of the print medium 106. Further, the sensor 112 measures PPS along the width of the platen during the scanning. For example, the PPS includes a relative distance between the printhead 110 (e.g., pen) and the platen 104 or the print medium 106. In the scan printer, the PPS (e.g., pen-to-print medium distance) may vary along the scan axis depending upon the defects of the platen, while in the page wide array printer, some printheads may be closer to the print medium than other printheads, also due to the platen defects. In both cases (i.e., scan printers and page wide array printers), the differences of printing fluid drop flying time may be compensated by applying a specific delay to each drop based on the platen defects and may requires to compute the profile of the platen. In one example, the sensor 112 applies a signal/beam 120 (e.g., an led beam, an ultra-sound beam, or a laser beam) to compute the PPS along the platen width. The sensor 112 can be a sensor having a precision of about 0.1 mm when the distance being measured is within a range of +/−1.5 mm. For example, the sensor 112 includes a short range distance sensor. An example sensor operation is described in detail in FIG. 2.

Figure 2:
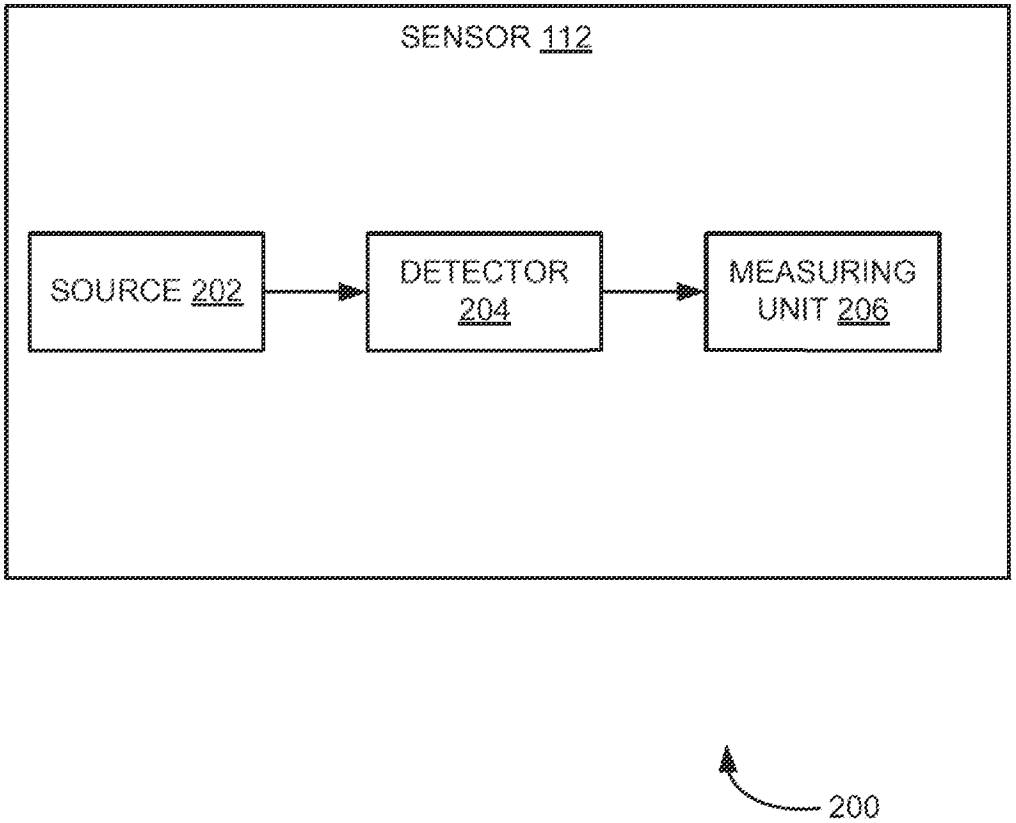
FIG. 2 is a block diagram illustrating an example sensor shown in FIG. 1.

Referring now to FIG. 2, which is a block diagram 200 illustrating an example sensor (e.g., the sensor 112 of FIG. 1). The sensor 112 includes a source 202 for emitting the beam (e.g., the detection beam 120 as shown in FIG. 1) towards the platen 104 or the print medium 106, a detector 204 for receiving source beam reflected from the platen 104 or the print medium 106, and a measuring unit 206 to measure the PPS at multiple positions along a length of the scanning axis by measuring intensity variations of the reflected beam at the multiple positions.

In one example, the sensor measures printhead-to-print medium spacing by projecting the beam to a print medium disposed at the printing-medium position, and receives the beam reflected from the print medium. In another example, the sensor measures printhead-to-platen spacing by projecting the beam to the platen disposed substantially at the printing-medium position when the print medium is absent or not loaded, and receives the beam reflected from the platen. In this case, a distance allowance corresponding to the thickness of the print medium that is absent from the platen can be included for computing a PPS profile.

Figure 4:
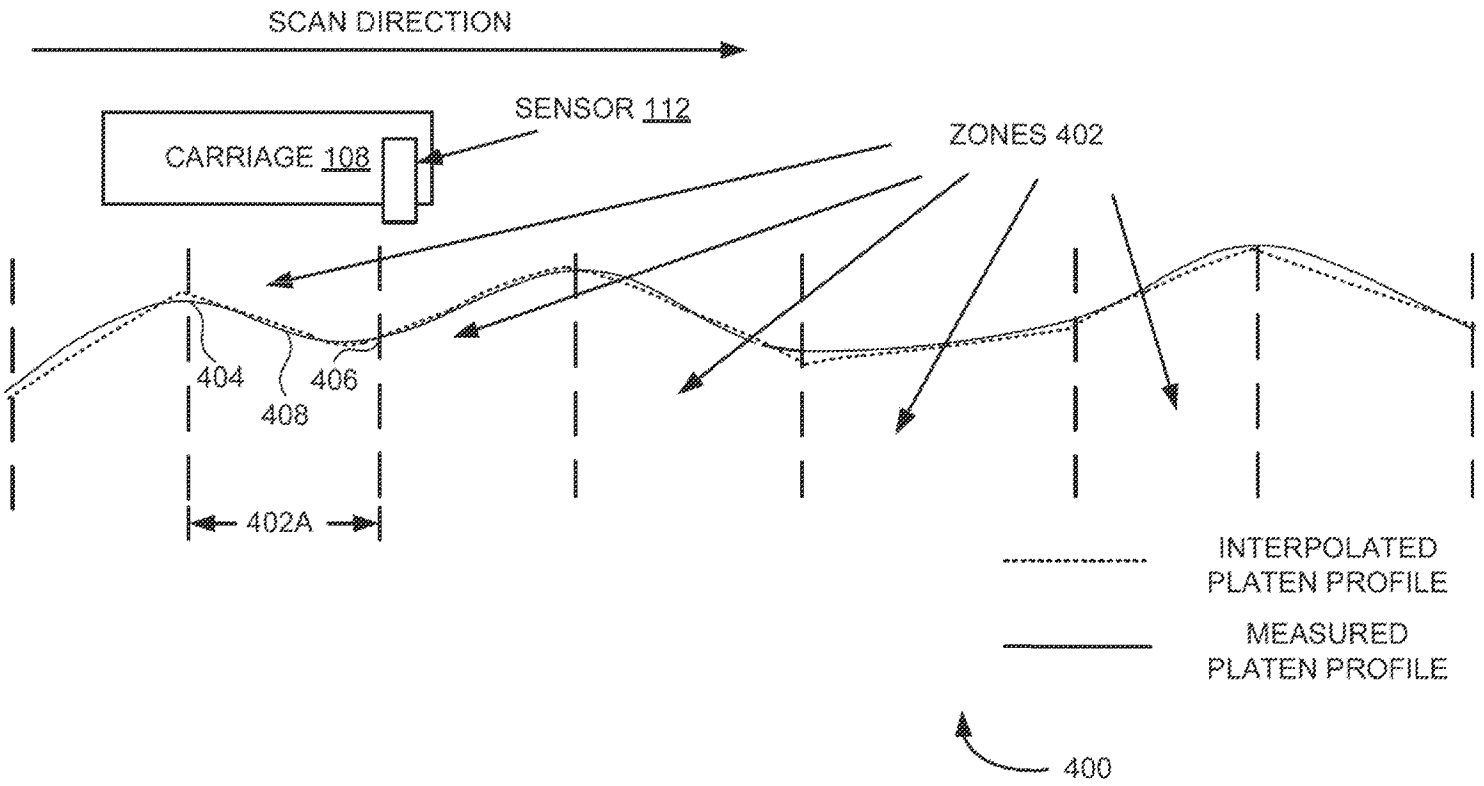
FIG. 4 is a perspective view of an example print medium/platen that is divided into a multiple zones.

Referring back to FIG. 1, the PPS analysis module 118 computes a PPS profile at multiple positions along the scanning axis by sampling the measured PPS and analyzes the computed PPS profile to determine potential defects that may prevent the printing operation or may damage the printhead. For example, the print zone area of the platen can be defined by a set of zones (e.g., zones 402 as shown in FIG. 4), with each zone having a start position, an end position and a specific slope. In this example, the potential defects may be determined by comparing each computed PPS profile at the set of zones along the scanning axis with a pre-defined threshold value corresponding to that zone.

When the potential defects that prevent printing operation or damage the printhead are determined, then the PPS analysis module 118 may generate an alert message or a warning tone. When there are no potential defects that prevent the printing operation or damage the printhead, the dynamic compensation module 116 delays the firing of printing fluid drops from the printhead 110 to compensate the platen defects based on the computed PPS profile, position and/or speed of the carriage 108, and velocity of propagation of the printing fluid drops from the printhead 110 towards the print medium 106. In one example, the PPS analysis module 118 may program the dynamic compensation module 116 to delay the firing of printing fluid drops from the printhead 110 to compensate for PPS fluctuations due to imperfections of the platen based on the computed PPS profile, position and/or speed of the carriage 108, and velocity of propagation of the printing fluid drops from the printhead 110 towards the print medium 106. This is explained in detail in FIG. 3.

Figure 3:
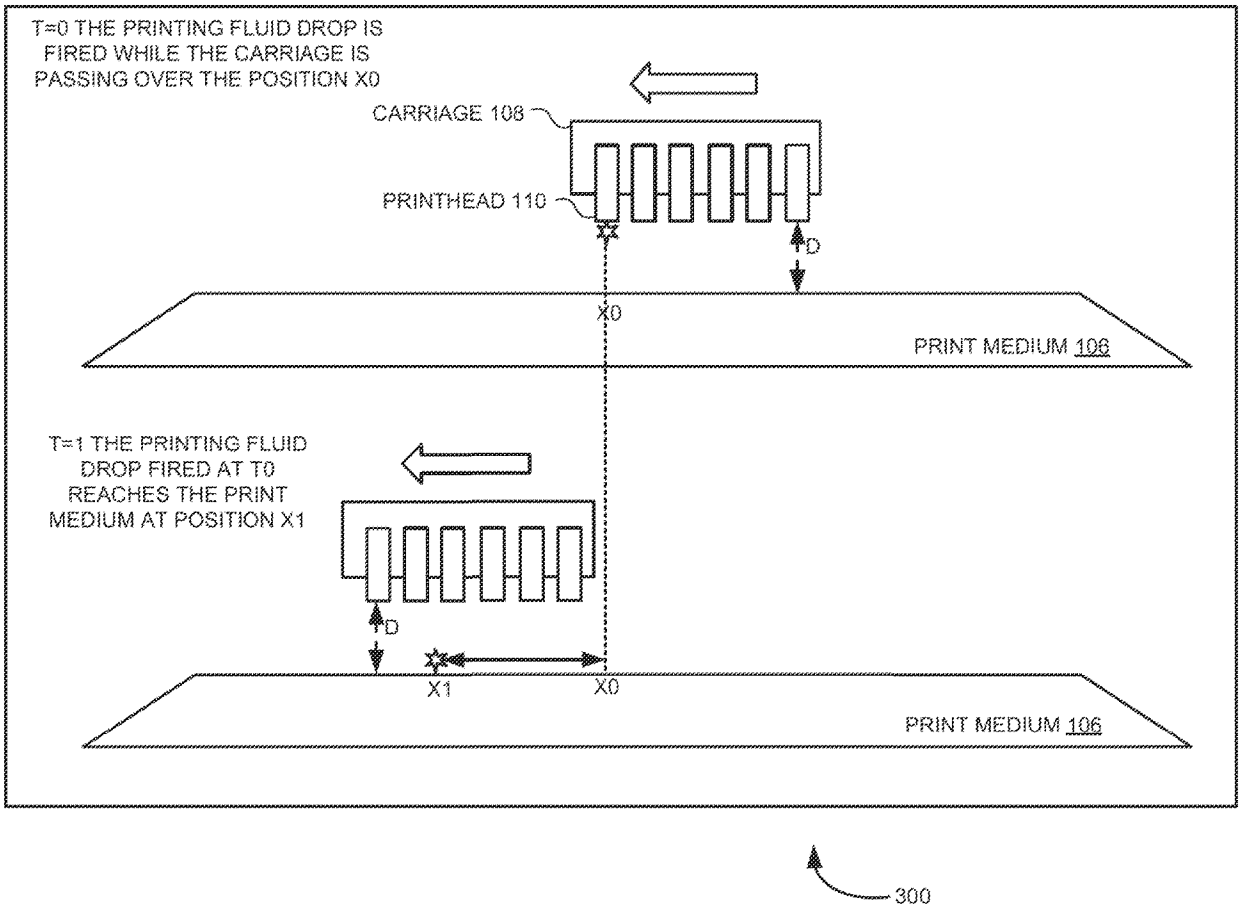
FIG. 3 is a timing diagram showing an example separation between an actual firing position of printing fluid drops and a position where the printing fluid drops print a print medium.

Referring now to FIG. 3, which is a timing diagram 300 showing a separation between an actual firing position of the printing fluid drops and a position where the printing fluid drops print the print medium 106. As shown in FIG. 3, the printing fluid drop is fired at T=0 while the carriage is passing over the position X0 on the print medium 106. Further, the printing fluid drop fired at T=0 reaches the print medium 106 at position X1 at T=1. The point X1 where the printing fluid drop actually prints the print medium 106 is separated from the point X0 where it was fired. The distance [X0,X1] (i.e., the distance between the position X0 and the position X1) depends on:

1. The carriage speed.
2. The printing fluid drop velocity, i.e., velocity of propagation of the printing fluid drops from the printhead 110 towards the print medium 106.
3. The distance between the print medium 106 and the printhead 110 (i.e., PPS).

The ratio of PPS to the printing fluid drop velocity defines the "flight time" of the printing fluid drop. The distance [X0,X1] depends on the "flight time" and on the carriage speed. If the PPS distance is not constant along the scanning axis, the "flight time" will vary accordingly. The distance [X0,X1] can be different for the printing fluid drops along the scanning axis resulting in IQ problems. In this case, the dynamic compensation module 116 workarounds this issue by compensating the "flight time" by a delay. A delay is applied to the fire pulse of the printing fluid drop to compensate for the flight time variations, for example, the smaller the flight time, the bigger the delay.

Referring back to FIG. 1, the PPS analysis module 118 transforms the computed PPS profile at multiple positions zones along the scanning axis into a format associated with an input of the dynamic compensation module 116 and provide the transformed PPS profile along with speed of the carriage, and velocity of propagation of the printing fluid drops to the dynamic compensation module 116 to delay the firing of printing fluid drops on the print medium 106. For example, the PPS analysis module transforms the PPS profile into the set of zones defined by their start position, end position and slope and then the transformed PPS profile is fed as input to the dynamic compensation module. This can be implemented by interpolating the computed PPS profile in order to obtain the set of zones. FIG. 4 is a perspective view 400 of an example print medium/platen that is divided into a multiple zones 402. As shown in FIG. 4, the zone 402A is defined by start position 404, end position 406 and slope 408. Also, FIG. 4 shows a computed PPS profile (e.g., as shown by think line) and interpolated PPS profile (e.g., as shown by dotted line). In one example, the PPS analysis module 118 programs the dynamic compensation module 116 to delay the firing of printing fluid drops on the print medium 106 by inputting the transformed PPS profile (e.g., number of print zones, a start position, an end position, and a slope for each print zone) to registers of the integrated circuit 114 (e.g., chipset).

Figure 5:
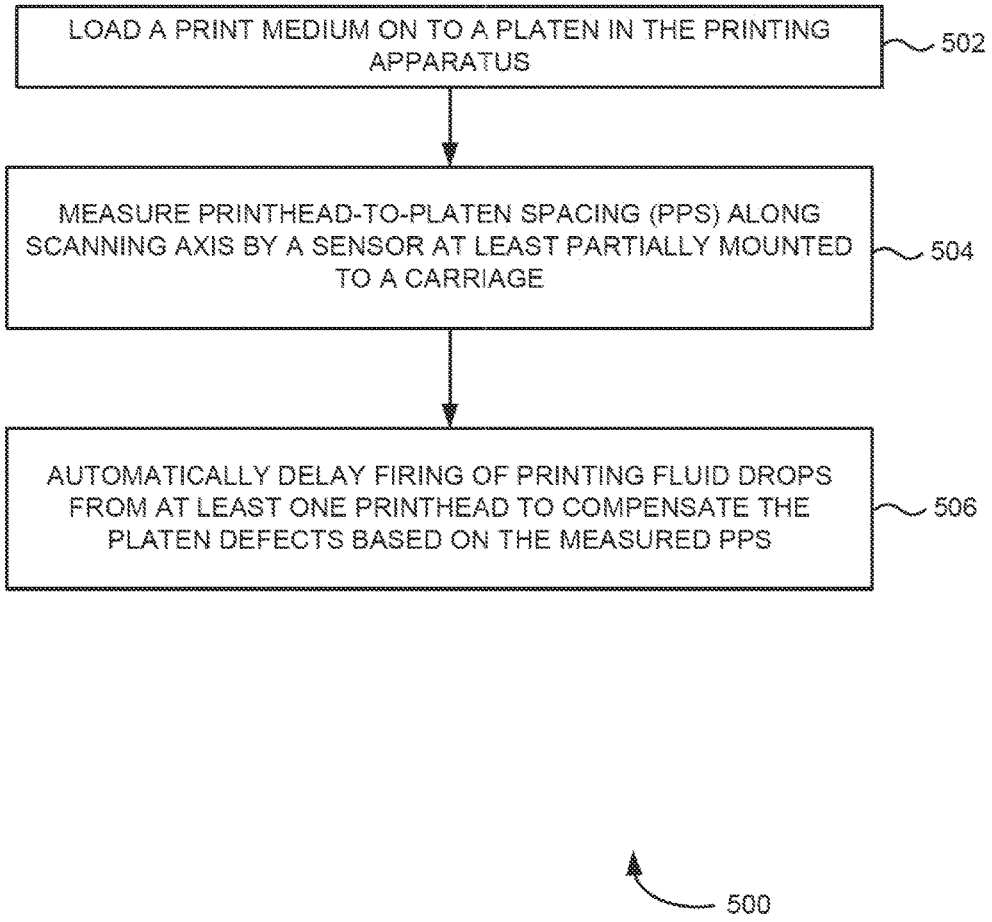
FIG. 5 is a flow diagram depicting an example method for compensating platen defects in a printing apparatus.

FIG. 5 is a flow diagram 500 depicting an example method for compensating platen defects in a printing apparatus, according to one embodiment. At step 502, a print medium (e.g., a bare print medium or unprinted print medium) is loaded on to a platen in the printing apparatus. At step 504, printhead-to-platen spacing (PPS) is measured along scanning axis by a sensor at least partially mounted to a carriage by initiating the carriage movement for scanning the print medium along a the scanning axis.

At step 506, firing of printing fluid drops from at least one printhead is delayed to compensate the platen defects based on the measured PPS. In one example, the firing of printing fluid drops from the printhead is delayed by computing PPS profile by sampling the measured PPS at multiple positions along the scanning axis and transforming the computed PPS profile into a format associated with an input of the dynamic compensation module and providing the transformed PPS profile to the dynamic compensation module to delay the firing of printing fluid drops from the printhead. For example, a print zone area of the printing apparatus is defined into a set of zones with each zone having a start position, an end position, and a specific slope. Further, programming the dynamic compensation module includes providing the computed PPS profile corresponding to the set of zones to the dynamic compensation module through 3 parameters, i.e., the start position, the end position, and the specific slope. As explained above, speed of the carriage and velocity of propagation of the printing fluid drops from the printhead towards the print medium are also considered along with the transformed PPS profile for programming the dynamic compensation module.

In another example, the computed PPS profile is analyzed to determine any potential defects that may prevent printing operation or may damage the printhead, and the firing of the printing fluid drops from the printhead is delayed to compensate the platen defects based on the computed PPS profile when there are no potential defects that prevent the printing operation or damage the printhead. In this example, the potential defects that prevent the printing operation or damage the printhead are determined by comparing each computed PPS profile along the scanning axis with a predefined threshold value.

The method and apparatus described through FIGS. 1-5 may automatically correct the platen defects without wasting the printer resources. Further, the dynamic compensation module can be updated on a regular basis, for example, each time when a new substrate/print medium is loaded on the printer. The method and apparatus described through FIGS. 1-5 improve the printer robustness as the printing is not performed when there is any default that prevents printing operation or damages the printhead. In addition, the method and apparatus described through FIGS. 1-5 improve the print quality by applying the PPS corrections more accurately.

Figure 6:
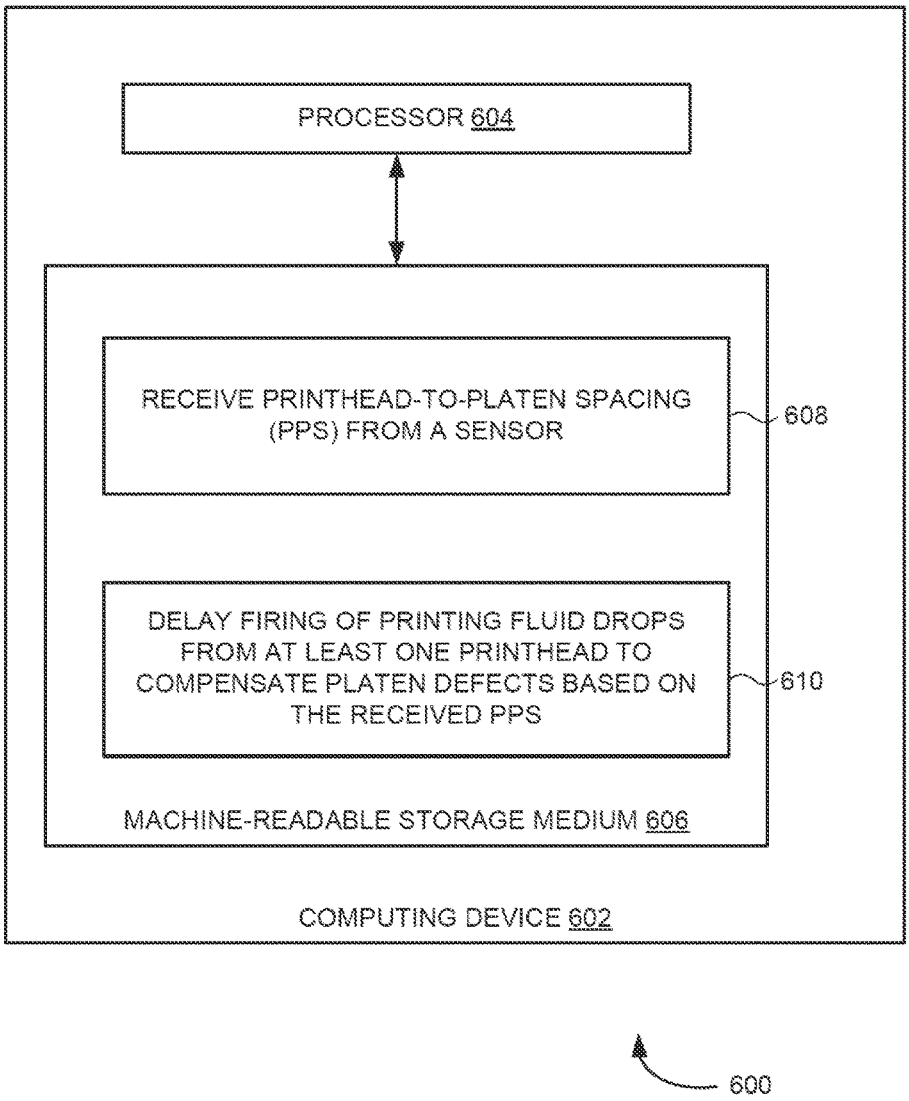
FIG. 6 illustrates a block diagram of an example computing device for compensating platen defects in a printing apparatus.

FIG. 6 illustrates a block diagram 600 of an example computing device 602 for compensating platen defects in a printing apparatus. The computing device 602 includes a processor 604 and a machine-readable storage medium 606 communicatively coupled through a system bus. The processor 604 may be any type of central processing unit (CPU), microprocessor, or processing logic that interprets and executes machine-readable instructions stored in the machine-readable storage medium 606. The machine-readable storage medium 606 may be a random access memory (RAM) or another type of dynamic storage device that may store information and machine-readable instructions that may be executed by the processor 604. For example, the machine-readable storage medium 606 may be synchronous DRAM (SDRAM), double data rate (DDR), rambus DRAM (RDRAM), rambus RAM, etc., or storage memory media such as a floppy disk, a hard disk, a CD-ROM, a DVD, a pen drive, and the like. In an example, the machine-readable storage medium 606 may be a non-transitory machine-readable medium. In an example, the machine-readable storage medium 606 may be remote but accessible to the computing device 602.

The machine-readable storage medium 606 may store instructions 608 and 610. In an example, instructions 608 and 610 may be executed by processor 604 to provide a mechanism for programming a dynamic compensation module for compensating platen defects in a printing apparatus. Instructions 608 may be executed by the processor 604 to receive printhead-to-platen spacing (PPS) from a sensor. The PPS is measured along the scanning axis by the sensor at least partially mounted to a carriage by initiating the carriage movement along a length of the scanning axis. Instructions 610 may be executed by processor 604 to delay firing of printing fluid drops from the printhead to compensate platen defects based on the received PPS.

It may be noted that the above-described examples of the present solution is for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All of the features disclosed in this specification (including any accompanying claims, abstract and drawings), and/or all of the steps of any method or process so disclosed, may be combined in any combination, except combinations where at least some of such features and/or steps are mutually exclusive.

Although the flow diagram of FIG. 5 illustrates specific orders of execution, the order of execution can differ from that which is illustrated. For example, the order of execution of the blocks can be scrambled relative to the order shown. Also, the blocks shown in succession can be executed concurrently or with partial concurrence. All such variations are within the scope of the present subject matter.

The terms "include," "have," and variations thereof, as used herein, have the same meaning as the term "comprise" or appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. An apparatus, comprising:

a platen for supporting a print medium;

a carriage;

a sensor at least partially mounted to the carriage, wherein the sensor measures a printhead-to-platen spacing (PPS) along scanning axis during scanning; and an integrated circuit comprising a dynamic compensation module and a PPS analysis module to delay firing of printing fluid drops from at least one printhead to compensate platen defects based on the measured PPS, wherein the PPS analysis module is to:

compute a PPS profile by sampling the measured PPS at multiple positions along the scanning axis;

transform the computed PPS profile into a format associated with an input of the dynamic compensation module; and provide the transformed PPS profile to the dynamic compensation module to delay the firing of printing fluid drops from the at least one printhead.

2. The apparatus of claim 1, wherein the PPS analysis module is to:

analyze the computed PPS profile to determine potential defects that prevent printing operation or damage the printhead; and provide the transformed PPS profile to the dynamic compensation module to delay the firing of printing fluid drops from the at least one printhead to compensate the platen defects based on the computed PPS profile when there are no potential defects that prevent the printing operation or damage the printhead.

3. The apparatus of claim 2, wherein the PPS analysis module determines the potential defects that prevent the printing operation or damage the printhead by comparing each computed PPS profile along the scanning axis with a pre-defined threshold value.

4. The apparatus of claim 1, wherein the sensor comprises:

a source for emitting a beam towards the platen;

a detector for receiving source beam reflected from the platen; and a measuring unit to measure the PPS at multiple positions along the scanning axis by measuring intensity variations of the reflected beam at the multiple positions.

5. The apparatus of claim 1, wherein the integrated circuit comprises a circuit selected from group consisting of field-programmable gate array (FPGA) and application-specific integrated circuit (ASIC).

6. The apparatus of claim 1, wherein the sensor comprises a sensor having a precision of about 0.1 mm when the distance being measured is within a range of +/−1.5 mm.

7. A method comprising:

loading a print medium on to a platen in a printing apparatus;

measuring a printhead-to-platen spacing (PPS) along scanning axis by a sensor at least partially mounted to a carriage by initiating the carriage movement along the scanning axis; and automatically delaying firing of printing fluid drops from at least one printhead to compensate platen defects based on the measured PPS, wherein automatically delaying the firing of printing fluid drops from the at least one printhead comprises:

computing a PPS profile by sampling the measured PPS at multiple positions along the scanning axis;

transforming the computed PPS profile into a format associated with an input of a dynamic compensation module; and providing the transformed PPS profile to the dynamic compensation module to delay the firing of printing fluid drops from the at least one printhead.

8. The method of claim 7, wherein automatically delaying the firing of printing fluid drops from the at least one printhead comprises:

analyzing the computed PPS profile to determine potential defects that prevent printing operation or damage the printhead; and delaying the firing of printing fluid drops from the at least one printhead to compensate the platen defects based on the computed PPS profile when there are no potential defects that prevent the printing operation or damage the printhead.

9. The method of claim 8, wherein analyzing the computed PPS profile to determine the potential defects that prevent printing operation or damage the printhead comprises:

determining the potential defects that prevent the printing operation or damage the printhead by comparing each computed PPS profile along the scanning axis with a pre-defined threshold value.

10. A non-transitory computer readable storage medium comprising a set of instructions executable by a processor resource to:

receive a printhead-to-platen spacing (PPS) from a sensor, wherein the PPS is measured along scanning axis by the sensor at least partially mounted to a carriage by initiating the carriage movement along the scanning axis; and delay firing of printing fluid drops from at least one printhead to compensate platen defects based on the measured PPS, comprising instructions to:

compute a PPS profile by sampling the measured PPS at multiple positions along the scanning axis;

transform the computed PPS profile into a format associated with an input of a dynamic compensation module; and provide the transformed PPS profile to the dynamic compensation module to delay the firing of printing fluid drops from the at least one printhead using the transformed PPS profile.

11. The non-transitory computer readable storage medium of claim 10, comprising instructions to:

analyze the computed PPS profile to determine potential defects that prevent printing operation or damage the printhead; and delay the firing of printing fluid drops from the at least one printhead to compensate the platen defects based on the computed PPS profile when there are no potential defects that prevent the printing operation or damage the printhead.

12. The non-transitory computer readable storage medium of claim 11, comprising instructions to:

determine the potential defects that prevent the printing operation or damage the printhead by comparing each computed PPS profile along the scanning axis with a pre-defined threshold value.

* * * * *